United States Patent [19]

Leveque et al.

[11] 4,283,013

[45] Aug. 11, 1981

[54] DISPENSER FOR A LIQUID PRODUCT

[75] Inventors: Jean-Luc Leveque, Montfermeil; Alain Guiolet, Paris; Jean-Claude Garson, Aulnay-sous-Bois, all of France

[73] Assignee: L'Oreal, Paris, France

[21] Appl. No.: 900,311

[22] Filed: Apr. 26, 1978

[30] Foreign Application Priority Data

Apr. 26, 1977 [FR] France ..... 77 12568

[51] Int. Cl.[3] ..... B65D 83/14

[52] U.S. Cl. ..... 239/304; 222/635; 239/346; 239/434.5

[58] Field of Search ..... 239/304, 307, 308, 353, 239/346, 398, 414, 434.5, 417.3; 222/133, 4, 193

[56] References Cited

U.S. PATENT DOCUMENTS

| | | | |
|---|---|---|---|
| 1,605,177 | 11/1926 | Diener | 239/434.5 |
| 2,054,136 | 9/1936 | Pfaff et al. | 239/434.5 |
| 2,625,431 | 1/1953 | Mueller | 239/434.5 |
| 3,305,134 | 2/1967 | Carmichael et al. | 239/304 |
| 3,357,647 | 12/1967 | Marraffino | 239/304 |
| 3,549,052 | 12/1970 | Forim | 222/135 |
| 3,648,932 | 3/1972 | Ewald et al. | 239/428.5 |
| 3,799,403 | 3/1974 | Probst et al. | 222/135 |
| 3,878,896 | 4/1975 | White | 239/304 |
| 3,982,668 | 9/1976 | Riccio | 239/307 |

FOREIGN PATENT DOCUMENTS

| | | | |
|---|---|---|---|
| 730806 | 6/1955 | United Kingdom | 239/434.5 |

*Primary Examiner*—Andres Kashnikow

*Attorney, Agent, or Firm*—Brisebois & Kruger

[57] ABSTRACT

A pressurized container includes a dispenser which releases liquid contents from the container into the atmosphere in the form of an aerosol spray by way of a discharge nozzle. Additional gas is injected into the dispenser under pressure and discharged with the spray to enhance the finely divided nature of the spray particles and to render more uniform the rate of discharge of the liquid contents as emptying of the container takes place. The container for the liquid product may be pressurized by a non-liquefied gas, for example carbon dioxide gas, and the additional gas may be supplied from a container of liquefied additional gas or a container of additional gas dissolved in a solvent medium.

12 Claims, 4 Drawing Figures

DISPENSER FOR A LIQUID PRODUCT

The present invention relates to a pressurised container intended for dispensing a liquid product in the form of an "aerosol" spray.

It is well known to dispense numerous liquid products in the form of a spray jet using pressurised containers comprising a valve which cooperates with a dispensing device comprising either a presentation and dispensing cap or a simple push button. This dispensing device generally comprises a duct system which is fed by the discharge valve of the pressurised container and is obstructed at its outlet end by a spray nozzle whose orifice is sufficiently small to produce a spray of the liquid arriving at the nozzle. The pressurised containers used at present are generally pressurised by means of liquefied propellant gases forming a liquid phase which is ejected at the same time as the liquid product is dispensed; at the moment when the liquid product is ejected through the orifice of the spray jet, the droplets of the spray jet are subjected to the atmospheric pressure and the liquefied gas contained in them is volatilised producing a division of the droplets. It follows from this that at the nozzle outlet a very fine spray of the dispensed product is obtained so that if the user places his or her hand in the path of the spray jet at a certain distance from the nozzle he or she will not have the impression of having the hand wetted by the aerosol obtained. Moreover, in this type of dispensing, the pressurisation pressure within the container remains present during the whole emptying process of the container, substantially constant and equal to the vapour pressure of the propellant gas at the temperature of use. Thus one has a substantially constant ejection pressure at the ejection nozzle during the whole dispensing operation and the dimensions of the dispensing devices are chosen so that for this pressure, the spray jet should have optimum geometry and dimensions; in general it is considered satisfactory to obtain a spray jet which constitutes a cloud when it has travelled approximately 30 cm from the spray nozzle and has spread through a cone with an angle of approximately 35° subtended at its apex.

It is also well known that the liquefied propellant gases used at present are frequently considered as being relatively undesirable for the environment, and that non-liquefied compressed gases, such as $CO_2$, have been considered. The drawbacks of using such a non-liquefied pressurised gas are twofold. In the first place, the liquid ejected via the spray nozzle comprises only the liquid to be dispensed and no longer comprises the liquefied propellant so it follows that the quality of the spray is distinctly worse because the droplets obtained are greater and no longer explode through the volatilisation of the propellant gas, as was the case with the device using liquefied propellant gases. In the second place, during dispensing of the product, the pressure within the container drops so that the flow conditions during the dispensing operation are not constant throughout the whole emptying of the container. These two drawbacks are extremely irksome because, on the one hand, the aerosol will not be sufficiently finely divided and, on the other hand, the dispensing is not effected in a substantially constant manner. Obtaining oversized droplets in the spray jet entails obtaining a "wetting" aerosol whose use is considered undesirable for the dispensing of cosmetic products such as hair lacquers. The variation of the dispensing conditions with time entails, moreover, the risk of the user being unable to use the last part of the product to be dispensed.

It is an object of the present invention to allow the above mentioned drawbacks to be overcome.

According to the invention, there is provided a dispenser comprising a pressurised container for holding a liquid product to be dispensed; and dispensing means comprising (a) a spray nozzle connected to at least one outlet from the container, and (b) ahead of the ejection orifice of said spray nozzle, at least one injection duct for additional compressed gas. With this dispenser the supply of compressed gas injected ahead of the ejection orifice, near the spray nozzle, and ejected at the same time as the liquid to be dispensed improves the quality of the spray. The expansion of this additional compressed gas allows an increase in the subdivision of the droplets of the spray obtained. A substantial improvement in the quality of the aerosols is obtained both as regards the reduced dimensions of the individual droplets obtained as well as the geometrical form of the spray jet as a whole. Thus, in the cosmetic field it is now possible to use spray jets which are "non-wetting" and will spread in a cone up to approximately 30 cm long having an angle at the apex of approximately 35°. It has then been surprisingly found that this injection of additional gas, which ensures an improvement of the spray, also has a considerable effect in improving constancy of the dispensing conditions during the gradual emptying of the container. It has, in fact, become apparent that the injection of additional compressed gas in the ejection zone is capable of ensuring regularity of the supply of the dispensed product delivered by the dispensing means. For a geometrically defined dispensing means, the injection of the additional compressed gas allows the delivery rate of liquid dispensed at the start of the emptying of the container to be reduced and the discharge rate of liquid dispensed at the end of emptying the container to be increased. This quite unexpected result makes it possible to obtain, with the dispensing device according to the invention, an ejection delivery rate which varies but little between the start and the end of the emptying of the container so that if quality of spray is good at the start of emptying, this same quality is retained until the end of the emptying of the container.

Thus, it is found that the injection of the additional compressed gas effected according to the invention, allows containers pressurised by means of non-liquefied gases to be usable in practice, for the dispensing of cosmetic product for instance. Up to now these could not be considered for the reasons indicated above. Thanks to the invention, it is now possible to avoid the use of liquefied propellant gases, such as the chlorofluorinated hydrocarbons, which are capable of being harmful to the environment.

In a preferred embodiment, the additional compressed gas is supplied by a further container which contains a liquefied gas or a gas dissolved in a solvent phase; this additional compressed gas is injected into the dispensing device via a small diameter gas injection duct ending near the spray jet; the diameter of the end of the gas injection duct is from 0.5 times to 1.5 times the diameter of the ejection orifice of the spray nozzle; the pressure of the additional gas injected is from 0.2 to 2 times the pressure obtaining in the pressurised container at the start of emptying of the container.

Carbon dioxide may now advantageously be used as the non-liquefied gas for the pressurisation of the container in which the liquid product to be dispensed is located. The additional gas injected may advantageously be a butane/propane mixture, or it may be a bromofluorohydrocarbon which is dissolved in an alcohol base and has extinguishing or flammability-reducing properties; bromotrifluoromethane is one convenient example of a suitable bromofluorohydrocarbon.

In a first variant, the injection duct for the additional gas has its outlet end arranged coaxially with the ejection orifice of the spray nozzle and adjacent the said orifice. In another variant, the injection duct for the additional gas is arranged ahead of the spray nozzle, substantially parallel to the direction of flow of the dispensed liquid. Provision may also be made for the injection duct to end ahead of the spray nozzle and to be directed at any angle with regard to the flow direction of the liquid to be dispensed.

When the dispensing means is a push button, the injection duct for the compressed additional gas ends in a zone between the outlet of the discharge valve of the pressurised container and the ejection orifice of the spray nozzle carried by the push button.

It has been found that the injection of the additional compressed gas allows the spray at the outlet of the nozzle to be considerably improved; the dimensions of the spray droplets obtained is reduced in relation to the case where no additional compressed gas is used, and the spray jet is accelerated so as to have the shape of an elongated cone as is necessary for the satisfactory distribution of cosmetic products in the form of an aerosol spray. Moreover, the liquid supply rate is made considerably more uniform in the course of the emptying of the container; in fact, for "aerosol cans" of conventional dimensions, filled with carbon dioxide gas at an initial pressure of 8 bars, it has been found that the emptying of the last third of the liquid product stored in the container was only effected with a progressively reduced discharge rate which could often be two to three times less than the initial discharge rate. With the dispenser according to the invention, using a suitable choice of the position and dimension of the injection duct; it is possible to maintain the variation in the discharge rate between the start and the end of the dispensing from a container to a value below 30%. It is found that the supply rate of the additional compressed gas is not constant during dispensing of the liquid product: it decreases uniformly at the start of the dispensing operation, then increases substantially at the moment when, in the absence of injection of additional gas, the discharge rate of the liquid would otherwise be subject to a rapid decline. Afterwards, it remains substantially constant. Although this explanation is not in any way to be held as limiting the invention, it is thought that the additional injected gas retards the ejection of the liquid product at the start of the dispensing and that, when the liquid supply rate has a tendency towards a rapid decline, the injected gas acts by way of a siphon effect to aid the ejection of the liquid product and thus to maintain the variation of the liquid discharge rate within limits.

In order that the present invention may more readily be understood several embodiments thereof will now be described merely by way of example, with reference to the accompanying drawing, in which.

Figure 3:
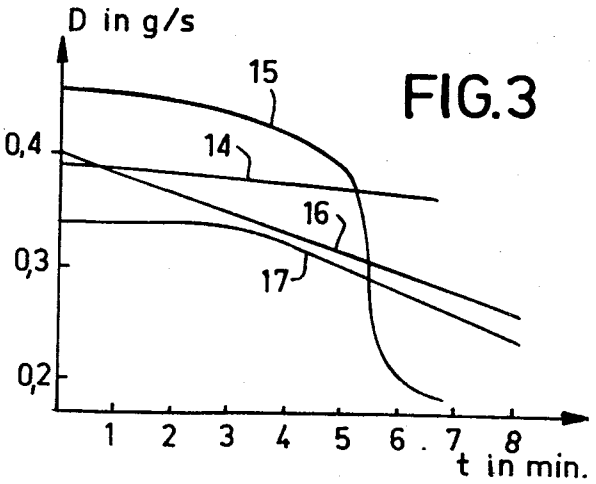
Figure 4:
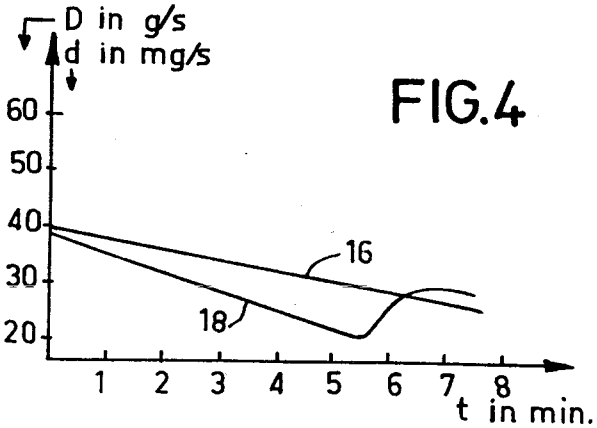
Figure 1:
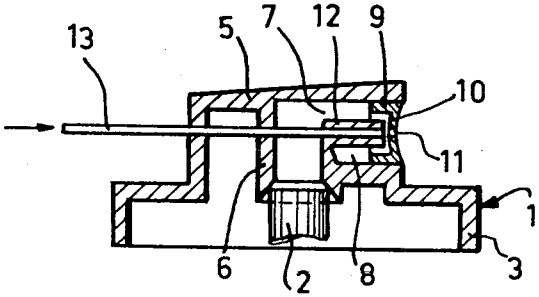
FIG. 1 is a schematic axial cross-section of a push button constituting a dispensing device of a pressurised container according to the invention.

FIG. 3 shows the curves of the liquid discharge flow rate from a container having the push button of FIG. 1, plotted against time, for various diameters of the gas injection duct (and in one case where there is no gas injection duct, in order to provide a comparison with a system which does not form part of the invention); and FIG. 4 shows the curves of discharge rate of both the liquid product and the additional gas, in the course of emptying a pressurised container fitted with the push button of FIG. 1.

Referring to the drawing, it will be seen that FIG. 1 represents a cross-section of a push button designated in its entirety by 1. This push button is intended to cooperate with the outlet tube 2 of the outlet valve of a pressurised container of the "aerosol can" type. The pressurised container 2; while shown only schematically, is constituted by a substantially cylindrical shell carrying at its upper part a discharge valve; this container contains a liquid product to be dispensed, for instance, an alcohol-based hair lacquer solution. Pressurisation of this container is achieved using carbon dioxide gas compressed at 8 bars. The capacity of the pressurised container is approximately 307 $cm^3$, and initially the container contains 190 $cm^3$ of the liquid phase to be dispensed.

The push button 1 comprises, at its lower part, a collar 3 surmounted by a cylinder 4 which is closed at its upper part by a surface 5 against which the user's finger is pressed. Near the axis of the cylinder 4 is a cylindrical connection 6 whose lower conically shaped part cooperates with the end of the outlet tube 2 of the discharge valve of the pressurised container. The cylindrical connection 6 is directed along the axis of the push button, that is to say along the common axis of collar 3 and cylinder 4, and the internal space defined by it communicates by way of a passage 7 with an annular cylindrical space 8 whose axis is perpendicular to the axis of the push button. The annular space 8 opens in the side wall of cylinder 4 and thus communicates with the exterior. A spray nozzle 9 is positioned within the cylindrical annular space 8 at the end thereof which is near the lateral wall of cylinder 4. Nozzle 9 is constituted by a cylindrical wall which both is coaxial with the cylindrical annular space 8, and obstructs the cylindrical annular space 8. Nozzle 9 also comprises an end panel 10 which is arranged adjacent the side wall of cylinder 4 and which includes at its centre an ejection orifice 11. The spray nozzle 9 is positioned in the cylindrical annular space 8 round a pin 12 which occupies the central zone of space 8 to leave sufficient space between the end panel 10 and the end of pin 12 to ensure communication between the internal space delimited by connection 6 and the exterior. End panel 10 carries, on the face opposite the pin 12 four substantially radial ribs formed in relief, these ribs regulating the space of end panel 10 in relation to pin 12 to ensure turbulence of the liquid product and propellant in the nozzle. The design described above is of a known type.

In accordance with the invention, an injection duct 13 for an additional gas is arranged coaxially of pin 12 to open opposite the ejection orifice 11. The injection duct 13 traverses the push button 1 along a diameter of cylinder 4 and is connected to a compressed gas container 13'. In the embodiment described, the vessel for the additional compressed gas is a subsidiary pressurised container closed by a discharge valve and enclosing a liquefied gas constituted by a butane/propane mixture having a vapour pressure of 4 bars at ambient temperature, i.e. Standard Room Temperature. Any mechanical device (not shown) can be used to connect the push button 1 to the outlet valve of the subsidiary pressurised container (not shown) and makes it possible to actuate the propellant gas container discharge valve when the push button 1 depresses outlet tube 2.

The ejection orifice 11 has a diameter of 0.33 mm; the distance between the pin 12 and the cylindrical wall of the nozzle 9 is approximately 0.2 mm; the distance between the pin 12 and the end panel of the nozzle 9 reduces from 0.3 mm to 0.2 mm in a direction radially inwardly from the peripheral zone of the panel to its central zone near ejection orifice 11. The internal diameter of the gas injection duct 13 is 0.4 mm.

With these conditions, it will be found that the operation of the pressurised container according to the invention, by the action of push button 1, allows the resulting spray jet to extend to approximately 30 cm from the nozzle with an angular spread of approximately 35°, the atomised droplets being sufficiently small for the user at the 30 cm distance to have the impression of a "non-wetting" aerosol. The fineness of the spray has been verified by means of photographs taken with an apparatus with an open shutter using a film having a speed rating of 3,000 ASA, by using an electronic flash lasting 2/50,000ths of a second. It has been found that the liquid discharge rate at the start of the dispensing was 0.39 g per second and the discharge at the end of the dispensing was 0.34 g per second. The curve showing the discharge rate with time has been designated as 14 in FIG. 3.

In FIG. 3, the time scale expressed in minutes has been shown as abscissa and discharge D expressed in g/second has been plotted as ordinate. Curve 15 shows the discharge variation if dispensing is carried out without using additional gas injection. Curves 16 and 17 show the discharge rate when the injection duct 13 for the additional gas has an internal diameter of 0.3 mm in the one case and 0.5 mm in the other case respectively. For this arrangement, it seems that optimum constancy of the discharge rate is achieved for an internal diameter of the injection duct 13 very slightly greater than the diameter of the ejection orifice 11.

FIG. 4 shows a graph representing as abscissa the emptying time (in minutes) of a pressurised container, according to the invention, and as ordinate, on the one hand, the discharge rate D (expressed in g/second) of the ejected liquid product and on the other hand, the discharge rate d (expressed in mg/second) of the additional compressed gas injected along duct 13. The curves shown in FIG. 4 correspond to the case where the internal diameter of the injection duct 13 of the push button of FIG. 1 is 0.3 mm. Thus in FIG. 4 curve 16 corresponds to curve 16 of FIG. 3 and illustrates the variation of the liquid discharge rate while curve 18 represents the variation of the discharge rate of the additional gas.

The right-hand ends (as viewed in the drawing) of curves 14, 15, 16 and 17 in FIG. 3 correspond to a complete emptying of the pressurised container. It will be seen that the variation in the rate of discharge of the additional compressed gas is not linear with respect to time, and that there will be an increase in the discharge rate of the additional gas substantially at the moment when, in the absence of any injection of additional gas, a sharp decline in the liquid discharge rate should have occurred.

Figure 2:
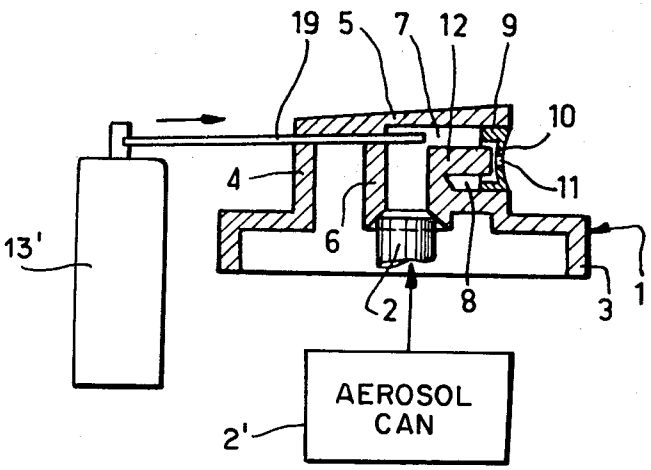
FIG. 2 illustrates a variant of the push button of FIG. 1.

An alternative embodiment of the spray nozzle according to the invention is shown in FIG. 2. In this variant, the spray nozzle is identical with the one previously described; only the position of the injection duct has been modified. This duct, designated as 19 in FIG. 2, has its outlet end arranged in the passage 7 and the axis of this outlet end is substantially parallel to the direction of flow of the liquid passing through passage 7. The other elements of the push button of FIG. 2 have been designated by the same references as for the corresponding elements of the push button of FIG. 1. The results obtained by means of the push button of FIG. 2 are similar to those obtained by means of the push button of FIG. 1.

It will be understood that the embodiments described above are in no way restrictive and may give rise to any desirable modifications without thereby departing from the scope of the invention as defined in the following statement of claim. For example, the orientation of the axis of the end of the injection duct when this duct is placed ahead of the spray nozzle as in the embodiment of FIG. 2 may be other than parallel to the direction of flow of the liquid product to be dispensed.

We claim:

1. A liquid product dispenser comprising a pressurised container containing a liquid product to be dispensed and a pressurised gas for discharging the liquid product from the container, outlet means on said container through which the liquid product is discharged, and dispensing means connected to said outlet means and comprising (a) a spray nozzle supplied with liquid product from said outlet means and having an ejection orifice, (b) injection duct means having an outlet disposed upstream of said ejection orifice of said nozzle for supplying additional compressed gas to mix with and dispense said product through said ejection orifice, and (c) a further container containing a liquefied gas to serve as said additional compressed gas, said further container being connected to said injection duct means.

2. A dispenser according to claim 1, wherein said additional gas is a butane/propane mixture.

3. A dispenser according to claim 1, wherein said additional compressed gas in said further container is a gas dissolved in a solvent phase.

4. A dispenser according to claim 3, wherein said dissolved gas is an extinguishing gas.

5. A dispenser according to claim 4, wherein said dissolved gas is bromotrifluoromethane.

6. A dispenser according to any one of claims 1 and 2 to 4, wherein said injection duct means for additional compressed gas comprises a small diameter tube having said outlet close to said ejection orifice of the spray nozzle.

7. A dispenser according to claim 6, wherein the injection duct means has an outlet end whose diameter is from 0.5 times to 1.5 times the diameter of said ejection orifice of the spray nozzle.

8. A dispenser according to any one of claims 1 and 2 to 4, wherein the pressure of the additional gas is from 0.2 to 2 times the pressure in an unused pressurised container at the start of the emptying of the said container.

9. A dispenser according to any one of claims 1 and 2 to 4, wherein said injection duct means for the additional gas has an outlet end arranged coaxially with said ejection orifice of the spray nozzle and adjacent the said orifice.

10. A dispenser according to any one of claims 1 and 2 to 4, wherein said injection duct means has an outlet arranged upstream of the spray nozzle, substantially parallel to the direction of flow of the dispensed liquid therepast.

11. A dispenser according to any one of claims 1 and 2 to 4, wherein said container contains a pressurising gas which is a non-liquefied gas.

12. A dispenser according to claim 3 wherein said additional compressed gas is a flammability-reducing gas.

* * * * *